United States Patent [19]

Ioka et al.

[11] Patent Number: 5,016,865

[45] Date of Patent: May 21, 1991

[54] SHEET FEEDING DEVICE FOR IMAGE RECORDING APPARATUS

[75] Inventors: Tsunejiro Ioka; Tatsuji Saigo; Michio Tomita, all of Tokyo, Japan

[73] Assignee: Seiko Instruments Inc., Japan

[21] Appl. No.: 293,115

[22] Filed: Jan. 3, 1989

[51] Int. Cl.[5] ..... B65H 3/08

[52] U.S. Cl. ..... 271/103; 271/107

[58] Field of Search ..... 271/11, 12, 103, 104, 271/107, 169

[56] References Cited

U.S. PATENT DOCUMENTS

| | | | |
|---|---|---|---|
| 3,893,663 | 7/1975 | Sanchez et al. | 271/169 X |
| 4,206,465 | 6/1980 | Tamoto et al. | 271/107 X |
| 4,508,331 | 4/1985 | Kashiwagi | 271/107 |
| 4,516,763 | 5/1985 | Stahl et al. | 271/107 X |

FOREIGN PATENT DOCUMENTS

| | | | |
|---|---|---|---|
| 57-72539 | 5/1982 | Japan | 271/169 |

*Primary Examiner*—David H. Bollinger

*Attorney, Agent, or Firm*—Bruce L. Adams; Van C. Wilks

[57] ABSTRACT

A sheet feeding device has suction cups carried by a linkage which is driven by a drive motor to sequentially press the suction cups onto a paper sheet, transfer the sheet held by the suction cups to another location, and release the sheet from the suction cups. The drive motor is connected to the linkage through a firction gearing mechanism which, through frictional slippage, prevents the suction cups from exerting excessive pressure on the sheets.

5 Claims, 6 Drawing Sheets

SHEET FEEDING DEVICE FOR IMAGE RECORDING APPARATUS

BACKGROUND OF THE INVENTION

1. Field of the Invention

This invention relates to a sheet feeding device, and more particularly to an improvement in such a device taking a sheet coated with an airtight material on the surface thereof.

2. Description of the Prior Art

For the purpose of producing hard copies of color pictures projected on a display screen of a CAD/CAM system, a thermal transferring printer or an inkjet printer is used. However, there are some problems with these techniques. It takes long to print out a picture, and only one color can be presented per dot so that the area of one picture element is large, therefore, the pictures printed are rough and not of the resolution.

In order to solve the above problems, another approach shown in U.S. Pat. No. 4,399,209 was proposed. A color imaging system that forms images by imagewise exposing a layer containing coloring precursors and a plurality of photosensitive compositions encapsulated in a layer of pressure rupturable microcapsules. The microcapsules are broken after putting then upon an image-receiving sheet applied with a developing material on the surface thereof, and the developing material reacts with the coloring precursors encapsulated in the ruptured microcapsules so that a predetermined image is transferred from the imaging sheet onto the image-receiving sheet. This imaging system seeks to present picture elements having the same size as those of the microcapsules. Therefore, color pictures can be printed with extremely high resolution.

However, there have been problems such that, since a powder developer is coated on the surface of the image-receiving sheet, the image-receiving sheet is scratched by a sheet feeding roller when it is taken out from a cassette causing the peeling off of the developing material, which not only deteriorates the picture image quality, but also causes duplicate sheets to be supplied because the sheet becomes difficult to slide due to the friction between the sheets.

SUMMARY OF THE INVENTION

An object and advantage of the present invention is to provide a sheet feeding device for an image recording apparatus which is able to move and work with the sheets without damaging the developing material on the sheet surface.

Another object of the present invention is to provide a sheet feeding device for the image recording apparatus which is able to move and work with the sheets one by one from the cassette without causing the problem of a duplicate supply.

The above and other related objects and features of the invention will be apparent from a reading of the following description of the disclosure found in the accompanying drawings and the novelty thereof pointed out in the appended claims.

DESCRIPTION OF THE PREFERRED EMBODIMENT

The present invention will be described in detail hereunder with reference to the accompanying drawings.

Figure 1:
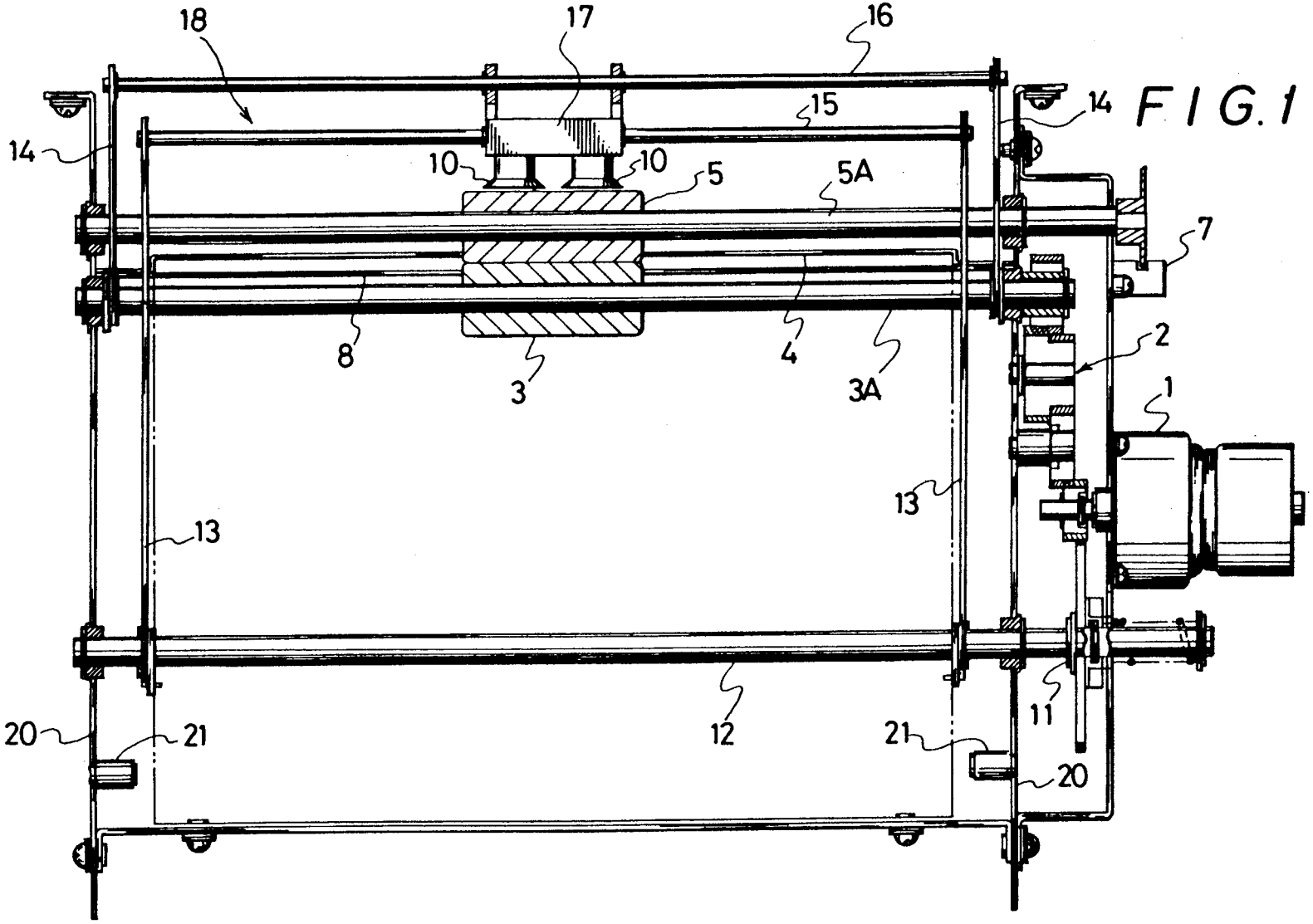
FIG. 1 is a front view of a sheet feeding device showing an embodiment according to the present invention.
Figure 2:
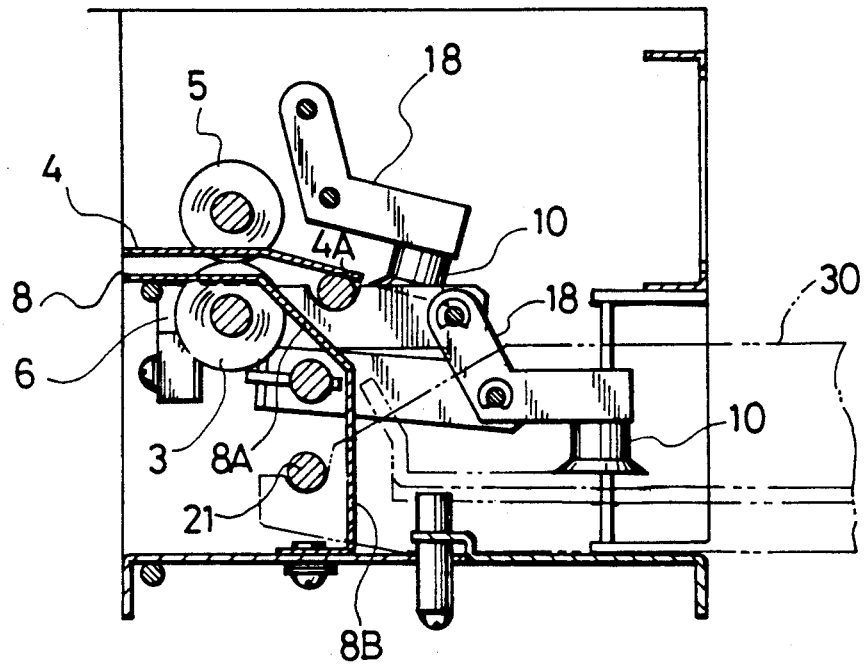
FIG. 2 is a side view of the sheet feeding device.
Figure 3:
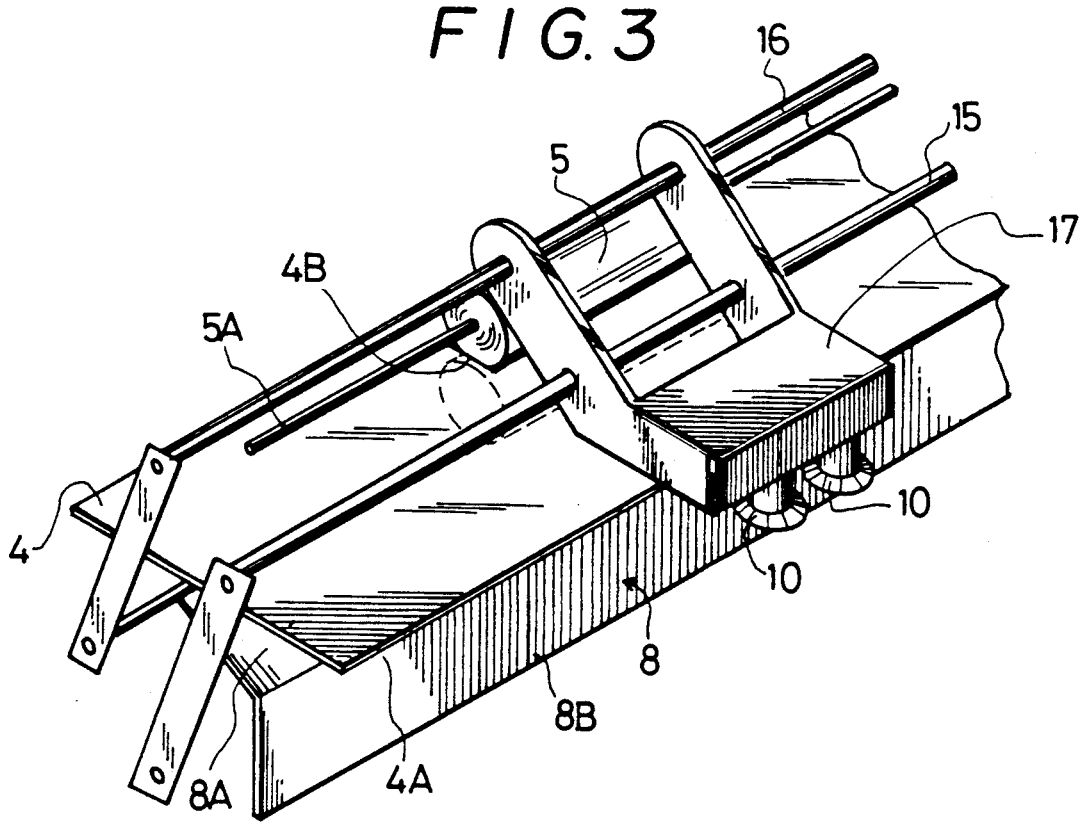
FIG. 3 is a perspective view showing a principal part of the sheet feeding device.

FIG. 1 and FIG. 2 show an embodiment according to the present invention, and FIG. 3 shows a perspective view showing a principal part of the present invention. In these figures, reference numeral 1 denotes a motor which receives a signal from a control circuit 40 (FIG. 5) described later and is connected to a roller drive shaft 3A of a sheet feed roller 3 through a gear train 2. At an upper part of this sheet feed roller 3, an upper guide plate 4 is disposed. The adjusting force means or point 4A of the guide plate 4 reaches out to a position to abut against suction cups 10, 10 described later when these suction cups 10, 10 move to a predetermined position. A pressing roller 5 is provided at a window 4B cut through at almost the central portion of the guide plate 4. A sensor 6 for detecting a sheet is disposed on the output side of these two rollers 3 and 5, and an encoder 7 is also mounted on a rotary shaft 5A which supports the roller 5.

A lower guide plate 8 forming a pair with the upper guide plate 4 is structured so as to include a first slant face portion 8A inclining downward gently and a second slant face portion 8B inclining almost perpendicularly at the tapering end thereof, namely, on the side of a cassette 30. The guide plates 4 and 8 comprise guiding means and the rollers 3, 5 and guide plates 4 and 8 together comprise receiving means.

The suction cups 10, 10 are fixed to a substrate 17 of a parallel link mechanism 18 the suction cups 10 and substrate 17 comprising suction-creating means. The substrate 17 is provided on shafts 15 and 16 fixed on a pair of arms 13, 13 and a pair of arms 14, 14 respectively. The pair of arms 13, 13 are fixed on a drive shaft 12 coupled to the motor 1 through a friction gearing mechanism or force adjusting means 11. The pair of arms 14, 14 are fitted with play to the roller drive shaft 3A. The absorption faces of the suction cups 10, 10 disposed on the substrate 17 look downward so as to move back and forth between the bottom of the sheet feed cassette 30 described later and the rollers 3 and 5. The motor 1, shaft 12 and arms 13 and 14 comprising driving force means.

Figure 4:
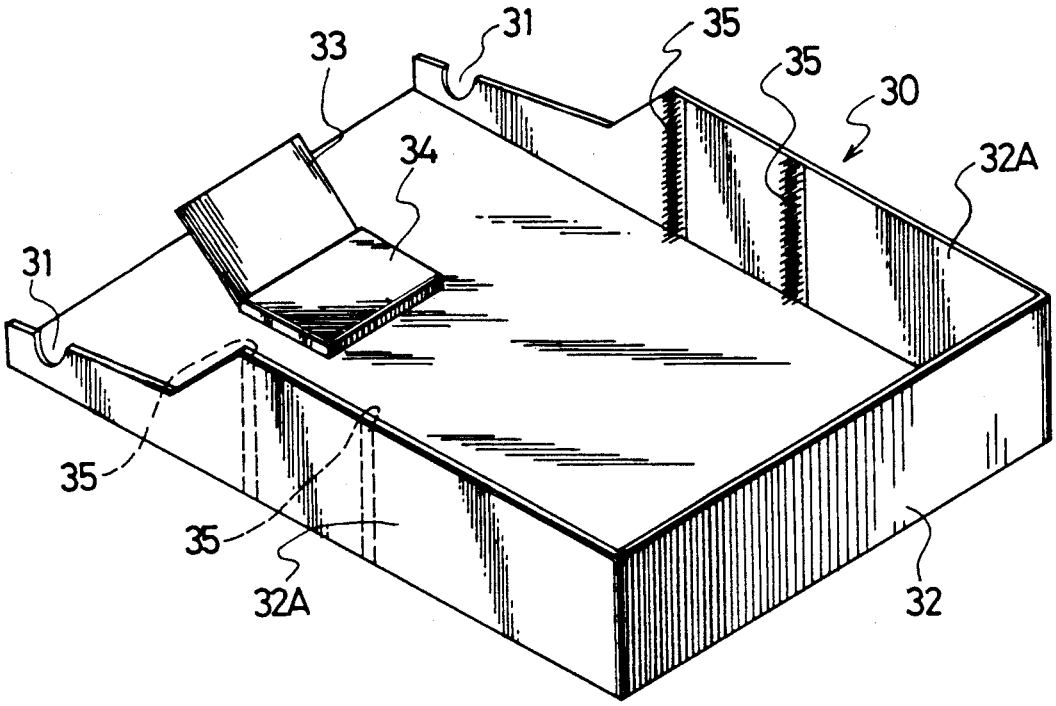
FIG. 4 is a perspective view showing an embodiment of a sheet feed cassette used in the sheet feeding device.

FIG. 4 shows an embodiment of above mentioned sheet feed cassette or paper holder 30 wherein said cassette is able to be attached and detached to protrusions 21, 21 provided on a frame 20 of the main body of the device by means of pawls 31, 31. The sheet feed cassette 30 is composed of a container 32 which opens on the side where the pawls are located, a central guide plate 33 which guides the central part of a sheet to the first slant face 8A of the lower guide plate 8 is fitted at the central part of the tip end, a base portion 34 for raising the central portion of the tip end in a mountain form when sheets are housed on the rear end side of the central guide plate 33, and furthermore, brush pieces 35, 35 protruding horizontally are provided on inner surfaces of sidewalls 32A, 32A.

Figure 5:
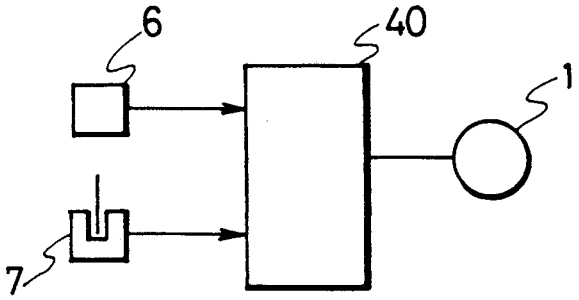
FIG. 5 is a block diagram showing an embodiment of a control unit of the sheet feeding device.
Figure 6:
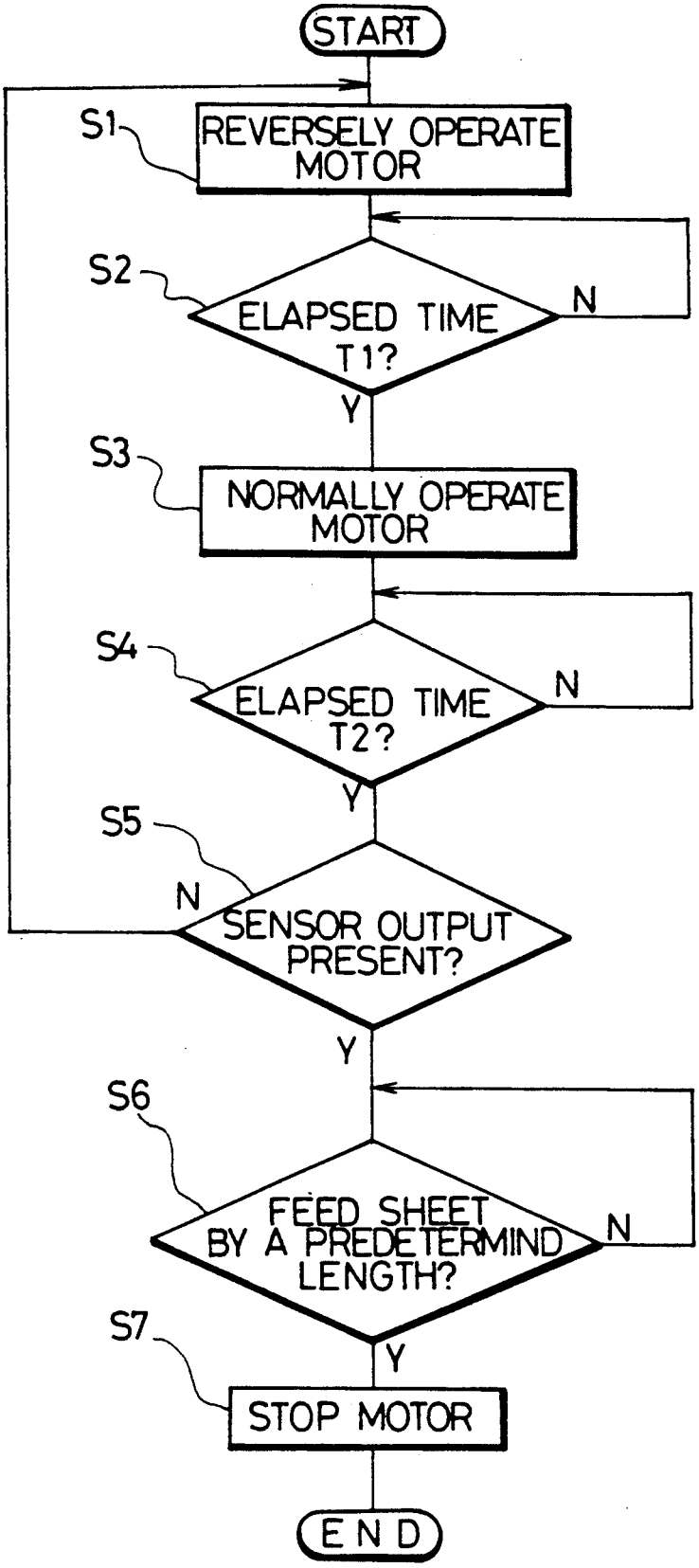
FIG. 6 is a flow chart showing the operation of the sheet feeding device.

FIG. 5 is a block diagram of a control unit of the sheet feeding device. The control circuit 40 comprised of a microcomputer is structured so as to rotate the motor 1 in normal and reverse directions at certain time intervals based on a flow chart as shown in FIG. 6 by receiving signals from the sheet sensor 6 and the encoder 7.

Figure 9:
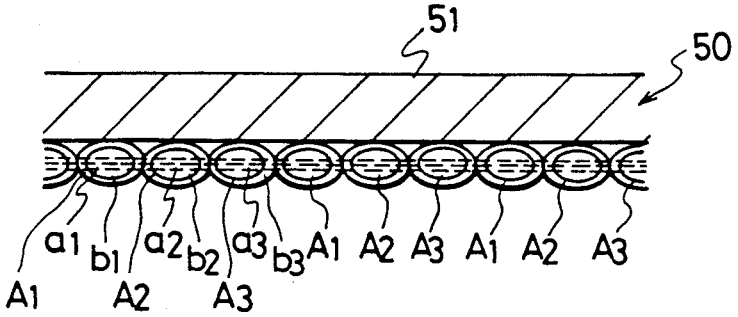
FIG. 9 is a sectional view showing an example of an imaging sheet used in the present invention.
Figure 10:
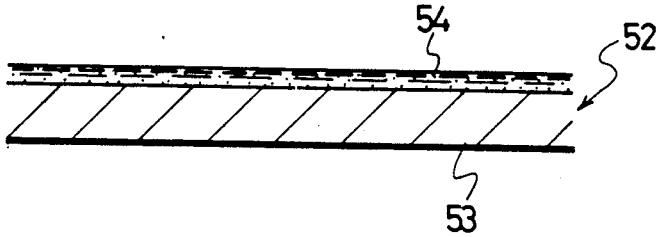
FIG. 10 is a sectional view showing an example of an imaging-receiving sheet used in the present invention.

FIG. 9 and FIG. 10 are respectively a sectional view of an imaging sheet and an image-receiving sheet suitable for the sheet feeding device according to the present invention. In FIG. 9, the imaging sheet 50 comprises a surface of a sheet 51 coated uniformly with respective microcapsules A1, A2 and A3 containing coloring precursors $a_1$, $a_2$ and $a_3$ assuming a cyanogen color, a magenta color and a yellow color, and sensitive components $b_1$, $b_2$ and $b_3$ that react upon light beams having different waveforms $\lambda_1$, $\lambda_2$ and $\lambda_3$ for every coloring precursor of each color and change viscosity, etc.

In FIG. 10, the image-receiving sheet 52 comprises a developing material 54 which develops colors by reacting upon coloring precursors $a_1$, $a_2$ and $a_3$ on the surface of a sheet 53. The image-receiving sheet 52 coated with the developing material 54 has an airtight character.

Figure 11:
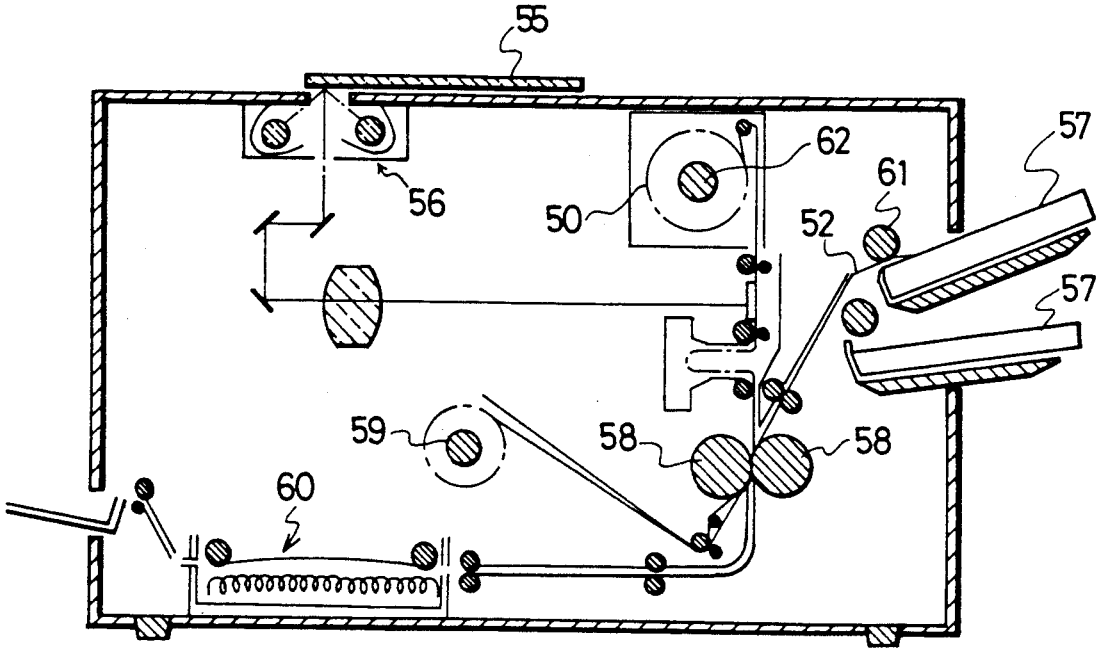
FIG. 11 is a block diagram showing an example of an image recording apparatus suitable for the sheet feeding device according to the present invention.

FIG. 11 is a sectional view showing an example of an image recording apparatus suitable for the sheet feeding device according to the present invention. High power cylindrical lamps, e.g. halogen lamps are disposed in a ease body 56 and provided with parabolic reflectors at the back thereof. The light from the lamps reflects off of an original image mounted on an original image mount 55. The reflected light is projected on the imaging sheet 50 through light reflecting and condensing member. The imaging sheet 50 is transferred from a feed roller 62 to a winding roller 59 through a light projecting station where latent images are formed on the imaging sheet 50. When the latent image is formed completely by the exposure device, a pressure sufficient to collapse microcapsules is applied by means of pressure rollers 58, 58 under such a state that an image receiving sheet 52 is fed from the sheet feed cassette 30 and placed it upon the imaging sheet 50, thereby to have coloring precursors in the quantity corresponding to exposure quantity ooze out onto the image receiving sheet 52. The image receiving sheet 52 is made to rise in temperature at a heating portion 60 so as to advance rapidly the reaction between coloring precursors $a_1$, $a_2$ and $a_3$ and the developer 54, thereby to assuming the colors of the picture image in the manuscript. According to such a recording system, it becomes possible to make a picture element the size of a micro capsule. Therefore, it becomes possible to print a high resolution color picture image.

The operation of the device thus structured will be explained based on the flow chart shown in FIG. 6.

When the image-receiving sheet 52 is housed in the sheet feed cassette 30 so that the developing layer thereof faces upward, the central guide plate 33 functions as a stopper, thereby preventing the sheet from slipping in the cassette 30.

Figure 7A:
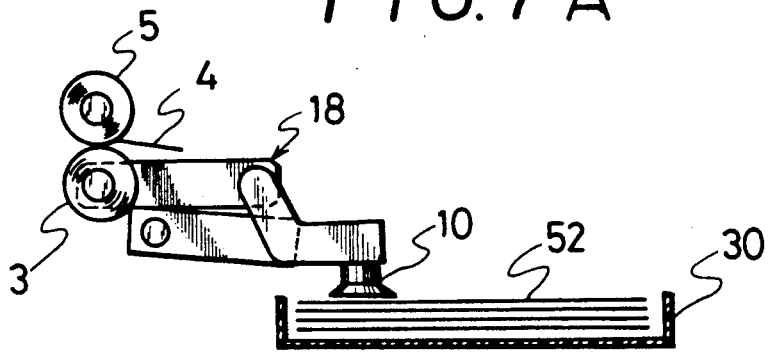
FIG. 7A and FIG. 7B are explanatory views showing the operation of the sheet feeding device.

When the device is operated after this cassette 30 is set to the main body of the device, the pulse motor 1 rotates in the reverse direction and moves the link mechanism 18 from side of rollers 3 and 5 to the side of the sheet feed cassette 30 through the friction gearing mechanism 11. In such a manner, when suction cups 10, 10 abut against the image-receiving sheet 52, the suction cups 10, 10 are pressed against the sheet surface, thereby to suction the sheet 52 as shown in FIG. 7A. Since this sheet is water proof, etc., and is coated with a developing material making it air tight, sufficient suction force is generated allowing the sheet to abut against the inner surfaces of suction cups 10, 10. In this manner the suction force is dispersed uniformly. As a result the sheet remains unscratched.

Figure 7B:
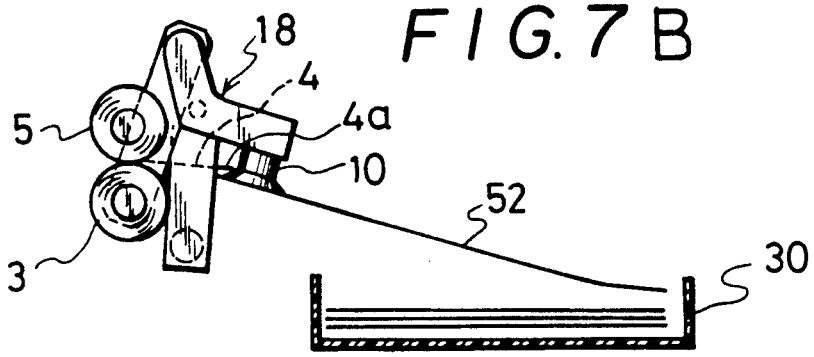

The pulse motor 1 rotates in the reverse direction until a predetermined time elapses during which suction sups 10, 10 abut against the sheet. However, since the power for driving the suction cups 10, 10 is controllably released the friction gearing mechanism 11, the pressing force applied to the sheet 52 is controlled to prevent excessive force from being applied to the sheet. When a predetermined time $T_1$ has elapsed, the motor 1 rotates in the normal direction and moves the link mechanism 18 upward once and then to the side of rollers 3 and 5. During this lifting process, the sheet 52 is lifted at the central portion thereof by suction cups 10, 10 and the second sheet attached on the underside thereof is made to fall with its own weight. Also, during the process of moving the sheet 52 to the side of rollers 3 and 5, the sheet 52 hangs downward with its own weight, and is guided upto the first slant face 8A of the lower guide plate 8 while keeping the central portion at the tip end being guided by the central guide plate 33. At this time, both ends of the sheet are hanging down, but the front half portion 8B of the lower guide plate 8 is formed almost at a right direction. Therefore, a free state is produced, and no extra force is applied. When the sheet ascends to the top of the central guide plate 33, the sheet is moved inbetween the rollers 3 and 5 while being guided by the first slant face 8A of the lower guide plate 8 and the upper guide plate 4. When the tip of the sheet moves to a position between the rollers 3 and 5, the suction cups 10, 10 touch the tip or suction-releasing means 4A of the upper guide plate 4. Therefore, the suction cups are bent, producing gaps between the cups and the sheet resulting in a loss of suction as shown in FIG. 7B.

At the time when the sheet is moved to the sensor 6 by the rollers 3 and 5 and a signal is output from the sensor 6, the control unit 40 operates the motor 1 until the signal from the encoder 7 reaches a certain number, thereby sending the sheet to a predetermined position for example, to the developing unit.

When the signal no longer being outputted from the sensor 6 (at step S5, where the parallel link mechanism 18 has completed the first reciprocating operation), the control circuit 40 rotates the pulse motor 1 in the reverse direction again so as to repeat the abovementioned process. As before, the next sheet is suctioned by means of suction sups 10, 10 and carried inbetween the rollers 3 and 5. At this time the sheet 52 should be located rear the side of the rollers more so than in the first case when the sheet 52 was completely housed in the cassette 30. Therefore, it is much easier to fit the sheet 52 in between the rollers 3 and 5.

As the sheets forced through the rollers the level of the sheet supply is lowered. The suction cups 10, 10, however, are driven with enough force determined by the friction gearing mechanism 11 to generate a certain suction force irrespective of the level of the supply sheets.

Figure 8:
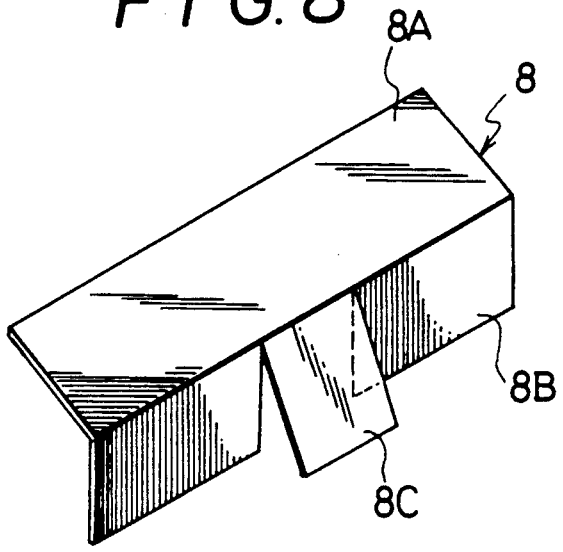
FIG. 8 is a perspective view showing an embodiment of a guide plate.

In the abovementioned embodiment, the central guide plate 33 is fixed to the cassette 30. However, it is apparent that the same operation may be performed by forming a tongue portion 8C by having the central portion of the lower guide plate 8 protrude partially as shown in FIG. 8 or by fixing a guide plate made of a different member to the central portion.

Also, in the abovementioned embodiment, two suction cups are provided widthwise but it is apparent that the same operation may be performed by disposing one, three or more suction cups in the moving direction.

Furthermore, in the abovementioned embodiment, the suction force is generated by means of a pressing force, but it is apparent that a similar operation may be performed by operating the suction and separation by means of a valve connecting the suction cups to a negative pressure source such as a vacuum through tubes.

Moreover, in the abovementioned embodiment, the suction cups are made to abut against the upper guide plate so as to release the suction force, but it is apparent that a similar operation may be achieved by having a different member abut against the upper guide plate.

Further, in the abovementioned embodiment, the central portion of the sheet is suctioned, but a similar operation may be performed by suctioning both side portions of the sheet.

As described above, according to the present invention, a sheet housing cassette 30 is disposed under the carrying-in side of sheet feed rollers 3 and 5 which are rotated by a driving source suction cups 10, 10 are provided on a member which moves back and forth between the rollers and cassette, thereby conveying a piece of sheet to the sheet feed rollers after lifting one end thereof by a suction force from suction cups 10, 10. Accordingly, it is not only possible to improve the picture image quality by reducing the friction force acting on the sheet surface thus preventing the peeling off of the developer, but also to accelerate the separation between sheets and prevent laminated misfeds from occuring. Finally, even if the first attempt to remove the shut from the cassette fails, for instance, it is possible to successfully convey the sheet inbetween the rollers by suctioning the sheet again until the sheet is fed properly.

What is claimed is:

1. An apparatus for lifting and moving image recording paper comprising:

suction-creating means movable between first and second positions for creating a suction force on a sheet of image recording paper and for lifting the paper by suction from the first position and moving the paper to the second position;

suction-releasing means for releasing the suction created between the suction-creating means and the paper at the second position, the suction-releasing means comprising means for displacing the suction-creating means from the paper to thereby release the suction at the second position, the means for displacing comprising a stationary member positioned to abut the suction-creating means when the same is moved to the second position thereby displacing the suction-creating means from the paper and releasing the suction;

driving means for driving the suction-creating means between the first and second positions; and force adjusting means for adjusting the suction force on the paper at the first position to prevent damage to the paper.

2. An apparatus according to claim 1; wherein the suction-creating means comprises suction cups pressable against the paper at the first position.

3. An apparatus according to claim 1; further comprising receiving means for receiving the paper released by the suction-releasing means.

4. An apparatus according to claim 1; wherein the driving means comprises shafts for driving the suction-creating means between the first and second positions.

5. An apparatus for lifting and moving image recording paper comprising:

suction-creating means movable between first and second positions for creating a suction force on a sheet of image recording paper and for lifting the paper by suction from the first position and moving the paper to the second position;

driving means for driving the suction-creating means between the first and second positions; and force adjusting means for adjusting the suction force on the paper at the first position to prevent damage to the paper, the force means adjusting means comprising a friction gearing mechanism.

* * * * *